United States Patent [19]

Fite et al.

[11] Patent Number: 4,814,613

[45] Date of Patent: Mar. 21, 1989

[54] COLLISION CELL FOR TRIPLE QUADRUPOLE TANDEM MASS SPECTROMETRY

[75] Inventors: Wade L. Fite; Suhas N. Ketkar, both of Pittsburgh, Pa.

[73] Assignee: Extrel Corporation, Pittsburgh, Pa.

[21] Appl. No.: 22,647

[22] Filed: Mar. 6, 1987

[51] Int. Cl.[4] ..... H01J 49/36

[52] U.S. Cl. ..... 250/292; 250/281; 250/282; 250/290; 250/293

[58] Field of Search ..... 250/292, 290, 293, 281, 250/282

[56] References Cited

U.S. PATENT DOCUMENTS

| | | | |
|---|---|---|---|
| 3,617,736 | 11/1971 | Barnett et al. | 250/292 |
| 3,783,279 | 1/1974 | Brubaker | 250/292 |
| 3,867,632 | 2/1975 | Fite | 250/282 |
| 3,937,954 | 2/1976 | Fite | 250/292 |
| 3,939,344 | 2/1976 | McKinney | 250/292 |
| 4,013,887 | 3/1977 | Fite | 250/292 |
| 4,234,791 | 11/1980 | Enke et al. | 250/281 |
| 4,283,626 | 8/1981 | Siegel | 250/292 |
| 4,481,415 | 11/1984 | Takeda et al. | 250/292 |

*Primary Examiner*—Carolyn E. Fields
*Assistant Examiner*—John A. Miller
*Attorney, Agent, or Firm*—Penrose Lucas Albright

[57] ABSTRACT

Methods and apparatus for improving the performance of triple quadrupole tandem mass spectrometers consisting of constructing the collision cell surrounding the second quadrupole structure, into which collision gas is admitted, with end plates composed of leaky dielectric material which appear to radio-frequency electric fields as a dielectric and to dc electric fields as a conductor. The result is that the rf fringe fields extend farther away from the ends of the poles of the first and third analyzing quadrupole mass filter than do the dc fringe fields, thus keeping the ions on stable trajectories in the regions between the analyzing quadrupoles and the end plates of the collision cell, and improving the transmission of ions. The effect is enhanced by applying the same frequency and phase of the ac voltages applied to all three quadrupole structures.

20 Claims, 3 Drawing Sheets

MAGNETIC SECTOR MASS SPECTROMETER

COLLISION CELL FOR TRIPLE QUADRUPOLE TANDEM MASS SPECTROMETRY

BACKGROUND OF THE INVENTION

U.S. Pat. No. 2,939,952 to Paul et al describes the quadrupole mass filter. This device consists of four parallel hyperbolic electrically conducting (metal) sheets or circular rods to which a combination of radio-frequency (rf) and direct-current (dc) voltages are applied. If the values of the dc voltages and the amplitudes and frequencies of the rf voltages are selected correctly, only the ions of a specific mass-to-charge ratio are transmitted from one end of the quadrupole structure to the other. Ions with mass-to-charge ratios other than the ratio desired for transmission are on unstable trajectories and are rejected by moving transversely to the axis so they strike the poles and are electrically neutralized. The Paul et al patent also teaches that if only rf fields are applied to the structure, then ions of all mass-to-charge ratios in excess of a given value determined by the amplitude and frequency of the rf voltage applied will be transmitted, and those with lower mass-to-charge ratios will be on unstable trajectories and will be rejected.

U.S. Pat. No. 3,129,327 to W. M. Brubaker teaches that an ion which is or would be on a stable trajectory within a quadrupole mass filter structure must pass through fringe fields from and adjacent to the ends of the structure, to enter or to leave the structure, and that while in the fringe fields, the selected ions are on unstable trajectories and can be rejected before reaching the quadrupole structure. The patent further teaches that a way to avoid rejection in the fringe fields at the entrance of the quadrupole structure is to place immediately before the quadrupole structure to which both rf and dc voltages are applied, a very short quadrupole structure to which only rf voltages are applied. In this way an entering ion "sees" first the rf fields which become substantial before it "sees" the dc fringe fields. This has been called by Brubaker the "delayed dc ramp". This arrangement keeps the entering selected ions on stable trajectories at all times while in the fringe fields and results in improved overall transmission of ions by the device and therefore improved sensitivity and performance.

U.S. Pat. Nos. 3,867,632 and 4,013,887 to Wade L. Fite teach a less complicated and still effective way of accomplishing the dc ramp effect. This is to pass the ions through a hollow tube placed immediately before the quadrupole structure to which both rf and dc voltages are applied, said tube protruding slightly into the space between the four quadrupole rods and being made of a leaky dielectric material which appears as essentially a dielectric to rf fields and as a conductor to dc fields. The rf fringe fields penetrate the walls of the tube and appear within its interior; the dc fringe fields terminate on the outer surface of the tube and are not present within the tube. The incoming ions passing along the length of the hollow tube therefore "sees" the rf fields first and remain on stable trajectories while within the tube. On emergence from the tube, the ions "see" the dc fringe fields but because of the rf fields are already of substantial value, the ions remain on stable trajectories as they pass through the dc fringe fields.

U.S. Pat. No. 4,234,791 to C. G. Enke et al teaches the technique of triple quadrupole tandem mass spectrometry. The disclosures of this patent and others mentioned above are incorporated herein by reference. In the technique disclosed in the Enke et al patent, a first quadrupole mass filter structure is placed so that it is received ions from an ion source. The first quadrupole structure has both rf and dc voltage applied to it so that it selects and transmits ions of a given mass-to-charge ratio (parent ions). "Parent" ions emerging from the first quadrupole structure enter a collision cell into which an atomic or molecular gas has been admitted so that the parent ions collide with the collision gas atoms or molecules. This fragments parent ions and produces "daughter" ions. Within this collision cell is placed a second quadrupole structure, but one to which only rf voltages are applied. Because a quadrupole mass filter structure to which only rf voltages are applied transmits all ions with a mass-to-charge ratio greater than a value determined by the amplitude of the rf voltage of a given frequency, both parent ions and daughter ions with mass-to-charge ratios greater than the value determined by the amplitude of the rf voltage applied to the second quardupole structure emerge from the collision cell. These ions enter a third quadrupole mass filter to which both dc and rf fields are applied, where the mass-to-charge ratios of both parent and daughter ions are determined. The purpose of having the rf-only quadrupole structure inside the collision cell is to negate the effects of angular deflections in the fragmenting collisions. In the absence of the rf-only quardupole structure, daughter ions would for the most part be scattered to the walls of the collision cell and not emerge from the collision cell. By providing the rf-only quardupole structure, the fragment ions are confined to trajectories about the axis of the structure which ensures a vast majority of the daughter ions proceed along that axis, emerge from the collision cell and enter the third quadrupole mass filter. The amplitude of the rf voltage applied to the second quadrupole structure is normally less than applied to either of the first or third structure order to ensure that all daughter ions of interest are transmitted through the second quadrupole structure.

In most embodiments of the triple quadrupole tandem mass spectrometer, the collision cell is cylindrical and is constructed of metal. The end plate of the cell are also constructed of metal and have apertures at their centers to allow ions to enter and exit the collision cell. Gas leaks out of the collision cell through these apertures in sufficient quantities to require high pumping speed on the vacuum chamber housing the entire unit.

Because the end plates are constructed of electrically conducting metal, the rf and dc fringe fields between the first quadrupole and the entrance end plate of the collision cell are coincident in space, so that the ions emerging from the first quadrupole mass filter are on unstable trajectories as they approach the collision cell entrance aperture. Many of the ions that should enter the collision cell are therefore transversely rejected in the fringe fields and fail to enter the collision cell. A similar situation occurs at the exit end of the collision cell where the fringe fields between the exit end plate and the third quadrupole cause further rejection of the ions. These two ion rejection processes cause reduction of transmitted ions and therefore a loss of signal strength.

A common method to reduce the rejection of ions in the regions outside the two end plates is to place an electrostatic lens (also of metal) near both end plates, with its potential being sufficiently high that the ions are accelerated to higher velocities while passing through these regions of instability. By thus shortening the time that the ions are in regions of instability, some improvement of transmission is achieved.

A second common method to improve ion transmission is to make the apertures in the collision cell end plates large, so that some of the ions on unstable trajectories may be taken into the collision cell before they get too far away from the axis. But this approach increases the gas load to be evacuated by the pumps and is therefore undesirable.

SUMMARY OF THE INVENTION

The present invention teaches the use of collision cell end plates made of a leaky dielectric material which act as a dielectric to the rf fringe fields and as a conductor to the dc fringe fields. This accomplishes the maintenance of high rf fringe fields between the adjacent quadrupole structures while eliminating or substantially reducing the dc fringe fields, thus keeping the ions on stable trajectories in the region between the two adjacent quadrupole structures.

Subsequent to the introduction of triple quadrupole tandem mass spectrometry, other types of tandem mass spectrometers have come into usage that replace either the first or third analyzing quadrupoles by a mass spectrometer that uses either a magnetic sector or a combination of electric and magnetic sectors, but retains a collision cell enclosing a quadrupole structure and another quadrupole mass spectrometer for analysis of either the parent or daughter ions. The present invention also applies to such instruments in improving their performance when the end plate of the collision cell adjacent to the analyzing quadrupole mass spectrometer is constructed of a leaky dielectric material.

Other uasges, as adaptabilities and capabilities of the invention will be understood by those skilled in the art as the description progresses, reference being made to the accompanying drawings, in which:

The essence of the present invention is that by using an end plate with a material that appears as a conductor to the dc fringe fields but as a dielectric material to the rf fringe fields, that is a "leaky dielectric", and driving the radio frequency voltages on both quadrupole structures in the same phase, the rf electric fields remain high in the region between the quadrupole structures and the ions stay on stable trajectories as they traverse the region and two quadrupole structures.

Figure 4:
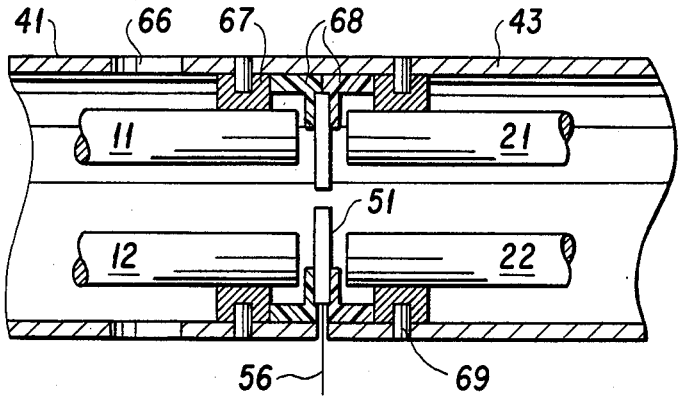
Figure 5:
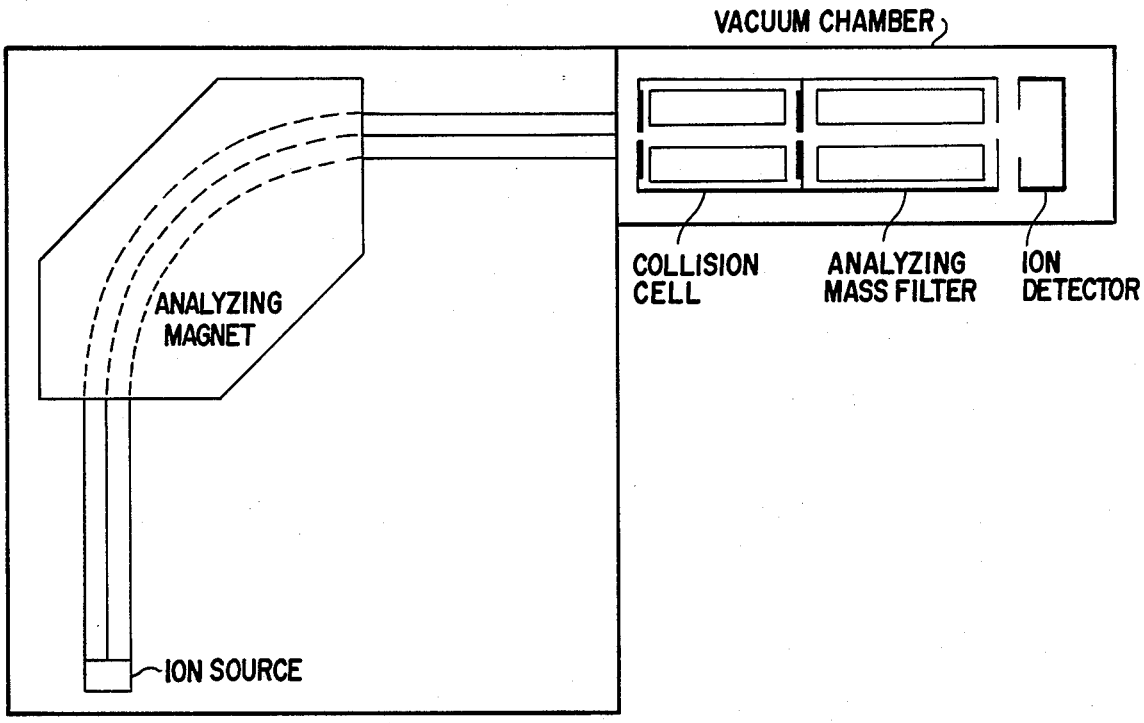

FIG. 4 illustrates the structure of a triple quadrupole tandem mass spectrometer in accordance with the invention. FIG. 5 is a diagrammatic representation of a tandem mass spectrometer with a magnetic sector for a first analyzer, a collision cell for receiving ions therefrom, the collision cell having end plates composed of leaky dielectric material, and an analyzing quadrupole structure for the analysis of daughter ions transmitted from the collision cell that includes an ion detector.

DESCRIPTION OF THE PREFERRED EMBODIMENTS

Figure 1:
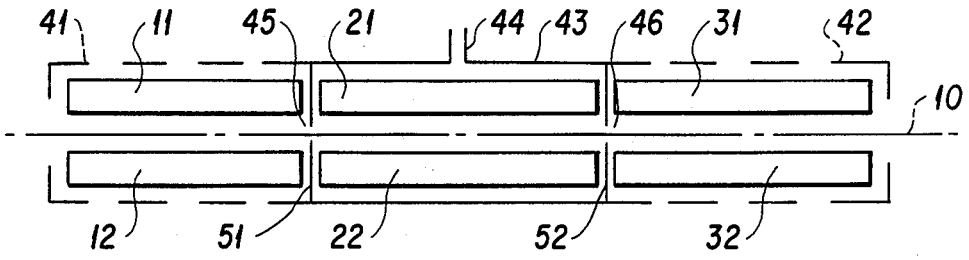
FIG. 1 depicts a triple quadrupole structure, in which two of the four poles in each quadrupole structure are shown. The middle quadrupole is housed in a collision cell, to which gas is admitted, said gas leaking out of the collision cell through the apertures in the end plates on the axis of the triple-quadrupole structure. The voltages placed on the left and right quadrupole structure are a combination of rf and dc voltages, so that both act as analyzing mass filters, while the voltage placed on the middle quardupole structure is rf only, thus making it an ion pipe for both parent and daughter ions.

FIG. 1 illustrates a typical quadrupole structure, which is circularly cylindrically symmetrical about the horizontal axis 10. Two of the four poles, 11 and 12, 21 and 22, and 31 and 32, in each of the three quadrupole structures are shown. Surrounding the second quadrupole structure is a collision cell consisting of a tube 43 with end plates 51 and 52. Gas (with which ions entering the collision cell will have fragmenting collisions) is admitted through tube 44 and leaks out of the collision cell through apertures 45 and 46, through which the ions respectively enter and leaves the collision cell. The entire triple quadrupole structure is housed within a chamber held at high vacuum and gas received in the vacuum chamber from the collision cell is removed by the vacuum pumps which evacuate the vacuum chamber.

The first quadrupole structure is contained within a case 41 which has openings to permit gas flowing from the collision cell into the first quadrupole structure to escape rapidly into the vacuum chamber surrounding the entire triple quadrupole structure and not remain within the first quadrupole structure and its case 41. Similar openings, slots or holes, are placed in the case surrounding the third quadrupole structure.

Figures 2A, 2B, 2C:
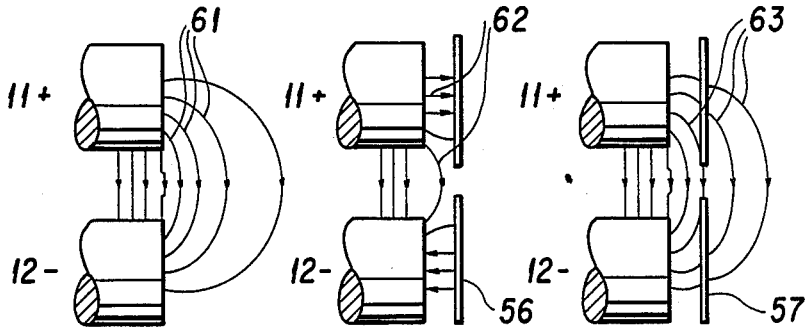
FIG. 2*a* shows the electric fringe fields near the ends of two adjacent poles of opposite electric polarity in a quadrupole structure. It is seen that the electric field lines extend to the right substantially beyond the ends of the poles.
FIG. 2*b* illustrates the effect of providing an electrically conducting, i.e., metal, end plate of a collision cell located near the ends of the adjacent poles in a quadrupole structure. It is seen that those field lines which formerly extended far to the right of the ends of the poles in the absence of such a metal end plate do not now do so, but instead terminate on the conducting plate. The electric fields are essentially zero on the right side of the end plate in the figure.
FIG. 2*c* shows the electric fringe fields when the end plate of the collision cell is composed of a highly dielectric material. The field lines do not extend as far to the right as in the case of no end plate at all, but do penetrate the dielectric material and extend substantially farther to the right than if the end plate is an electrical conductor.

FIGS. 2*a*, 2*b* and 2*c* depict qualitatively the electric field in the fringe fields near the ends of two adjacent poles of a single quadrupole structure under these circumstances.

FIG. 2*a* represents the fringe field lines 61 near the ends of poles 11+ and 12−, and + and − designating the polarity of voltages placed on the poles. The field between the poles to the left of their ends is strong as represented by the high density of the field lines. The density of the lines decreases as one moves to the right of the pole ends and at relatively large distances, the wide spacing between field lines indicates that the fringe fields are quite weak and decreasing as they extend toward the right.

FIG. 2*b* depicts the situation if a plate 56 of a conducting material is placed near the ends of the poles 11+ and 12−. The case shown is for the magnitude of the potentials on the poles being the same but of opposite polarity and the plate's potential being zero, or ground. It is seen that the field lines 62 continue to be strong to the left of the pole ends but the field lines which extend relatively far to the right in FIG. 2*a* now terminate on a conducting plate 51. There is effectively zero field to the right of the aperture 45 in the plate.

FIG. 2*c* shows situation if a plate 57 is made of a dielectric material. Although the field lines 63 are shifted in direction somewhat as they penetrate through the dielectric material and are not as strong to the right of the end plate as they would be in the absence of such dielectric plate (i.e., in FIG. 2*a*) substantial fringe fields do exist on the right side of the plate 57.

The above qualitative statements are based on the theory of electromagmetism (see J. D. JACKSON, CLASSICAL ELECTRODYNAMICS, 1962, John Wiley & Sons, and other standard textbooks).

For voltages applied to the rods 11 ad 12, which are a combination of rf and dc voltages, if the plate is of a leaky dielectric material, i.e., one that acts like a dielectric to the rf fields and as a conductor to the dc fields, then ions "see" fringe fields as shown in FIG. 2*c* for the rf fields and as shown in FIG. 2*b* for the dc fields. Ions therefore leaving the quadrupole structure and moving toward the right, and similarly ions moving from the right to the left and entering the quadrupole structure, remain on stable trajectories. A plate of leaky dielectric having an aperture 45 acts similarly to the hollow tube described in U.S. Pat. No. 3,867,632.

The requirements for materials of such plates have been discussed in U.S. Pat. No. 3,867,632. The key parameter is the number given by $2n\sigma/EW=2\sigma/Ef$, where $\sigma$ is the electrical conductivity of the material and E is its dielectric constant in cgs units, f is the frequency in Hz and $w=2nf$ is the angular frequency in radians per second. If $2\sigma/Ef<<1$ the material acts as a conductor and if $2\sigma/Ef<<1$, it acts as a dielectric. Translating this into practical units, for frequencies in the low MHz range and materials with dielectric constants of 3–7, the material acts as a dielectric if the resistivity $\rho=1/\sigma$, is very much greater than about $10^5$ ohm-cm. In practice synthetic materials such as Cerramag C-11 which is available from Stackpole Carbon Company of St. Mary's, Pennsylvania, and certain naturally occurring materials, such as slate, with resistivities of around $10^7$ ohm-cm have proven satisfactory. For some applications, resistiities up to $10^9$ ohm-cm can be useful. Such material acts as conductors to dc fields where the frequency f approaches zero. Even if one is scanning the mass range and thus changing the "dc" voltage, this occurs at a typical size of only 10 Hz or less (10,000 amu/sec over a 1000 amu mass range), and the frequency is still low enough for the material to appear as a conductor. Thus, for the purpose of this invention, voltage subjected to variations caused by scanning of the mass range used in mass spectrometers is considered "dc" voltage.

Figure 3A:
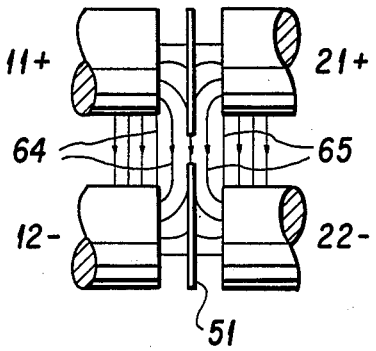
FIG. 3 shows the situation when a dielectric end plate is placed between the poles of two quadrupole structures, where the upper and lower of the poles have the same polarities. In this case the electric fields penetrating the dielectric material from one side add to the electric fields on the other side of the dielectric material, so that the electric fringe fields of the two quadrupole structures remain high throughout the region between the two quadrupole structures.

FIG. 3*a* shows the situation where plate 51 is the end plate 51 of the triple quadrupole structure in FIG. 1. On the other side of the end plate 51, which is here highly dielectric material, there is a quadrupole structure consisting of poles 11+ and 12− on the left and 21+ and 22− on the right. As in FIG. 2*b*, the drawing illustrates the situation where the magnitudes of the voltages on the poles are the same but the polarities are opposite, and the intermediate end plate is at zero or ground potential. In this case the rf field lines from the left set of poles 11+ and 12− penetrate to the right side of the end plate, much as they do in FIG. 2*c*, although the presence of the right set of plates 21+ and 22− cause the penetrating field lines to change direction in the downward direction. These penetrating field lines add to the field lines from the right set of poles 21+ and 22−, and cause a strengthening of the electric field represented by 65 on the right side of end plate 51. Similarly, rf electric field lines from the right set of poles 21+ and 22− penetrate the end plate and add to the field lines from the left set of poles 11+ and 12− and thus strengthen the electric field 64 on the left side of end plate 51. The resulting electric field shown, since the end plate 51 is using its dielectric properties, is that for the radio frequency voltages applied to both quadrupole structures, i.e., the drawing represents the electric field of one instant of time and as time varies, the polarities of the poles 11, 12, 21 and 22 reverse polarities at a rate equal to the frequency of the rf voltage.

Figure 3B:
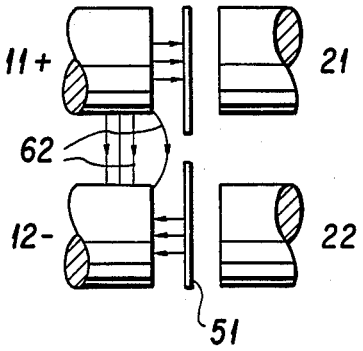

FIG. 3*b* represents the situation for the dc voltages. Since the middle quadrupole structure has only rf applied to it, the dc voltage on plates 21 and 22 is zero or ground. End plate 51 is also zero dc potential so that there are effecively no dc fields to the right of the endplate 51. The electric field lines are thus confined to the left side of the end plate 51 and are effectively identical to the field lines 62 in FIG. 2*b*.

The ions traversing from the left to the right thus "see" rf fields represented by 64 and 65 in FIG. 3*a* and "see" dc fields represented by 62 in FIG. 3*b*. The task of keeping the ions in strong rf fields while the dc fringe fields are reduced along the ions path of travel is thus accomplished.

FIG. 3*a* shows the polarities of the voltage poles 11+ and 21+ at any given instant to be the same, and similarly so for poles 12− and 22−. This situation occurs if the rf voltages are operating at the same frequency and in the same phase.

Although having the same frequency and phase achieves the maximum rf fringe field strength and thus the greatest stabilization of the ion trajectories in the fringe field region, it is not a necessary requirement for the invention to give improvement in transmission of ions through the fringe field regions. In particular, if the amplitude of the rf voltage on the second quadrupole structure 21 and 22 is substantially less than that on the quadrupole structure 11 and 12, which is usually the case in triple quadrupole tandem mass spectrometry, the rf field lines will more nearly resemble the lines 63 in FIG. 2*c*, irrespective of the frequency or phase of the rf voltage applied to 21 and 22. But, even in this case the rf fringe fields extend considerably beyond the range of the dc fringe fields and appreciable stabilization of the trajectories is found.

In the above discussion the case was considered in which ions leave the quadrupole structure on which both rf and dc fringe fields are placed and enter the collision cell in which the quadrupole structure has only rf voltages applied to it. Because of the symmetry of the triple quadrupole structure of FIG. 1, the same type of interaction occurs for ions leaving the rf-only quadrupole and passing through aperture 46 in the end plate 52 and into the third quadrupole structure 31 and 32, to which again both rf and dc voltages are applied. The same stabilization of trajectories thus occurs at the exit as well as the entrance end.

Experiments have been performed at Extrel Corporation in Pittsburgh, Pa., using a triple quadrupole structure consisting of three identical Model 162-5 quadrupole structures. Each has four circularly cylindrical poles ⅝" diameter and length of five inches. A stainless steel collision cell 43 was fitted alternatively with stainless steel end plates 51 and 52, with ¼" diameters of the apertures 45 and 46, or with end plates made of Cerramag C-11 of the identical geometry. The experiments were performed without gas in the collision cell. The rf voltages on all three quadrupoles were derived from the same rf oscillator so that all three quadrupoles operated at the same frequency and in approximately the same phase. The experiments were performed by setting the first quadrupole to select one of the several ions formed in electron bombardment of perfluorotributyamine with masses up to 502 atomic mass units. The ions passed through the evaucated collision cell and its rf-only quadrupole. The dc voltages were on the third quadrupole were first set to zero, so that it acted on the ions like an ion pipe, i.e., similarly to the way the rf-only quadrupole inside the collision cell does. The current of the ions detected at the end of the third quadrupole is called $S_o$. The dc voltages were then applied to the third quadrupole and the values of the rf and dc voltages were selected so that the third quadrupole transmitted the same ion as was being selected by the first quadrupole. The current of the ions detected at the end of the third quadrupole is called $S_1$. Transmission is defined as the ratio of $S_1/S_o$. This is really the transmission through the fringe fields at the junction of the second and third quadrupoles, since transmission between the first and second quadrupoles was the same irrespective of the voltages applied to the third quadrupole.

It was found that using the stainless steel end plates with ¼" apertures, the transmission for an ion at 69 amu was typically 14% under a given set of operating conditions. Replacing the stainless steel endplates by the Cerramag C-11 end plates with ¼" apertures and 1/16" thickness gave, under the same operating conditions as before, typical transmissions of 37%. Inasmuch as there are two transition regions between the analyzing quadrupole structures and the central rf-only quadrupole structures, these percentages must be squared to obtain the fraction of ions introduced at the first of the three quadrupole structures to emerge from the third of the three quadrupole structures. This is to say that with the metal end plates, the percentages of ions introduced that emerge from the triple quadrupole structure is $(0.14)^2=0.0916$, whereas with Cerramag C-11 end plates, the percentage is $(0.37)^2=0.1369$. By using the Cerramag C-11 end plates, a total signal improvement of $0.1369/0.0196=6.98$ over the signal obtained using metal endplates is found. In other words the signal is improved about seven fold with the leaky dielectric plates.

If one used ⅛" aperture diameter in the 1/16" thick Cerramag C-11 end plates, the measured transmission does not appreciately decrease below that of the ¼" aperture. This suggests that the field separation caused by the leaky dielectric end plate caused the transverse motion in the ion trajectories to diminish so that the ions remain closer to the axis as they proceeded along the diminishing rf fringe fields after leaving the dc fringe fields. But whatever the cause, the fact is that by using leaky dielectric end plates with ⅛" diameter apertures, one can again get better transmission by a factor of almost seven while reducing the gas load on the vacuum pumps by a factor of four, in contrast with metal end plates of ¼" diameter aperatures. An overall improvement factor of about twenty-eight between combined signals strength and pumping speed requirements was found experimentally.

Although a circular aperture is preferred, elliptical aperatures and slots have useful applications. Whatever the configuration, apertures of about 0.003 to 0.015 square inches and less are preferred to reduce vacuum pumping requirements.

Finally, it is found desirable electrically to bias the leaky dielectric endplates with respect to the case of the collision cell and also with respect to the potential along the axis of the first and third quadrupoles, so that the leaky dielectric endplates also act as an axially symmetric electrostatic lens between quadrupole structures. In such case, the resistivity of the material should be near $10^5$ ohm-cm.

FIG. 4 illustrates the structure a triple quadrupole structure in which electrically biasable end plates are mounted.

In this embodiment, the case housing all three quadrupole structures is a single piece of metal tubing. That portion of the case that houses the first analyzing quadrupole structure (11 and 12) is divided for descriptive purposes in the portion 41 that houses the first quadrupole structure, which contains openings 66, to allow gas to escape into the vacuum, and the solid walls 43 of the collision cell which houses the second quadrupole structure 21 and 22. The poles of the first and second quadrupole structures, 11 and 12, and 21 and 22, are held within electrically insulating ceramic yokes 67. The location of yokes 67 within the case 41 and 43, is determined by the location of screws or pins 69. (In the case of the Extrel experiments, items 69 were screws).

The leaky dielectric end plate 51 is held between two insulating adapters 68, made of either a ceramic material such as alumina or plastic material such as Kel-F. They are shaped completely to fill the space between yokes 67. They are also cut away so as to accept the leaky dielectric collision cell end plate 51 as shown in FIG. 4. Finally, a key is cut into the insulating adapters 68 to permit the insertion of a wire 56 that makes contact with the leaky dielectric end plate 51 so a dc potential can be applied to end plate 51. This causes it to act also as an axially symmetrical electrostatic lens between the first and second quardupole structures.

As previously indicated, because of the symmetry in the triple quadrupole structure, a similar or identical mechanical structure is installed at the interface between the second and third quadrupole structures.

As will be apparent to those skilled in the art, there are, of course, alternative structures that achieve the same practical effect of providing a collision cell with electrically biasable leaky dielectric end plates of the collision cell in triple quadupole tandem mass spectrometers.

As should be equally apparent to the skill of the art, should the first quadrupole structure within case 14 be replaced by a magnetic sector or other device for selecting parent ions of a given mass-to-charge ratio, the application of a leaky dielectric end plate for the collision cell again improves the ion transmission and therefore sensitivity by virtue of its presence between the second and third quadrupole structures.

Having disclosed our invention, what we claim of new and to be secured by Letters Patent of the United States is:

1. In a method of transmitting ions through fringe field regions adjacent to the ends of a quadrupole mass filter, the use of a flat plate composed of leaky dielectric material, a centrally located aperture in said plate, said plate being adjacent to the end of the poles of the quadrupole mass filter and connected to electrically conductive structure only at a location that is spaced radially from said aperture sufficiently so that it does not effectively interfere with the rf electric fringe fields generated from the ends of the poles of said quadrupole mass filter.

2. A method in accordance with claim 1 wherein said aperture has a diameter of about one-fourth inch or less.

3. In a method of transmitting ions through a triple quadrupole tandem mass spectrometer having a collision cell surrounding an rf-only quadrupole mass filter which is electronically aligned between two quadrupole structures of said spectrometer, the use of end plates for said cell which are composed of a leaky dielectric material and which have openings therein through which said ions are transmitted, the adjacent regions between said quadrupole mass filter and said two quadrupole structures having no electrically conductive material therein which can effectively block rf electric fields from passing through said end plates between the poles of said mass filter and said quadrupole structures.

4. A method in accordance with claims 1 or 3, wherein said leaky dielectric material has a dielectric constant in the approximate range of 1 to 10 and a resistivity in excess of $10^5$ ohm-cm.

5. A collision cell in a mass spectrometer comprising a quadrupole structure, a cell for said structure which includes a leaky dielectric end plate with an opening therein positioned for the transmission of ions, and means for biasing said end plate so that it functions as an electrostatic lens for ions transmitted therethrough, said biasing means comprising electrically conductive material, all electrically conductive material including said biasing means being spaced away from said opening sufficiently so as effectively not to interfere with rf electric fringe fields generated from the adjacent ends of said quadrupole structure from passing through said end plate.

6. In a method of transmitting ions through a mass spectrometer having the ends of two quadrupole structures adjacent each other and ions from a first of said quadrupole structures being received by a second of said quadrupole structures, the introduction of a leaky dielectric so that it is completely interposed between the respective adjacent ends of said structures and blocks dc electric fields from extending between said adjacent ends while permitting rf electric fringe fields to pass therethrough, an opening in said material for the transmission of said ions from one said structure to the other, said opening being remote enough from any electrically conductive material so that the adjacent electric fringe fields of said first and said second quadrupole structures are effectively coupled.

7. In a method according to claims 3 or 6, providing that said quadrupole structures have the same frequencies and phases of ac voltages applied simultaneously thereto.

8. Apparatus for improving the transmission of ions through the fringe field regions adjacent to at least one of the ends of a quadrupole mass filter comprising a flat plate of leaky dielectric material with an aperture centrally positioned therein, said plate being adjacent to the ends of the poles of said quadrupole mass filter, said plate being connected to electrically conductive material only where the electrically conductive material is spaced away from said aperture a sufficient distance so that such material effectively does not interfere with rf electric fields generated in said fringe field regions from said poles.

9. An apparatus in accordance with claim 8 wherein said aperture has a diameter of about one-fourth inch or less.

10. Apparatus for triple quadrupole tandem mass spectrometry wherein the second quadrupole is in a collision cell housing, said housing composed of leaky dielectric end plates which do not touch any electrically conductive material except in their peripheral areas.

11. Apparatus in accordance with claims 8 or 10 wherein the plates are composed of material which has a dielectric constant in the range from 1 to 10 and a resistivity of $10^5$ ohm-cm.

12. Apparatus composed of a leaky dielectric material comprising a collision cell in a triple quadrupole mass spectrometer, an end plate of said collision cell composed of a leaky dielectric substance, and means for electrically biasing said end plate including electrical conductive means operatively connected to said end plate, said end plate so constructed and arranged to function as an electrostatic lens for charged particles moving through same while at the same time acting as a device for spatially separating the dc and rf fringe fields between at least two quadrupoles of the triple quadrupole mass spectrometer, said lens being connected to said conductive means at a distance away from an opening in said end plate where the charged particles move through.

13. In a method of improving the ion transmission of a tandem mass spectrometer, the method comprising transmitting ions through a magnetic sector and magnetic fields of one of the mass spectrometers which is acting on said ions being transmitted therethrough, receiving said ions in a collision cell having therein a mass spectrometer and analyzing ions received from said collision cell in a further mass spectrometer, the use of an end plate between said collision cell and said further mass spectrometer which is composed of leaky dielectric material, said end plate defining an opening through which said ions are transmitted, said end plate not being in contact with any electrical conductor in the vicinity of said opening so that electric field fringe fields generated between the adjacent ends of said mass spectrometer in said collision cell and said further mass spectrometer are effectively transmitted through said end plate and are coupled in a manner that improves the transmission of said ions through said opening.

14. A tandem mass spectrometer comprising: a mass spectrometer having a magnetic sector;

a collision cell enclosing a quadrupole structure and having end plates defining apertures; and a quadrupole mass spectrometer including a further quadrupole structure; the mass spectrometers being positioned adjacent opposite ends of said collision cell, the end plate of said collision cell between said collision cell and said quadrupole mass spectrometer being composed completely of a leaky dielectric substance so that rf electric fringe fields from said quadrupole structures pass through said leaky dielectric substance in opposite directions and each rf electric fringe field so passing through said leaky dielectric substance adds to the strength of the other, and dc electric fringe fields generated by said quadropole structures are prevented from passing through said end plate composed of a leaky dielectric substance.

15. A mass spectrometer in accordance with claim 14 wherein said quadrupole structure and said quadrupole mass spectrometer have means for applying the same frequencies and phases of ac voltage simultaneously thereto.

16. A triple quadrupole tandem mass spectrometry device comprised three aligned quadrupoles, the second of said quadrupoles in a collision cell, the ends of said collision cell comprising end plates that define apertures therein, said plates each being composed of a leaky dielectric material and being sufficiently free of any conductive structure between said aligned quadrupoles wherein said end plates block the transmission of dc electric fields between said aligned quadrupoles while permitting rf electric fields to pass between said quadrupoles through said material surrounding said apertures.

17. A device according to claim 16 wherein said apertures have a diameter of one-fourth inch or less.

18. A device according to claim 16 wherein said apertures have a cross-section in the range of between about 0.003 and 0.05 square inches.

19. Apparatus according to claims 12 or 16, wherein said quadrupoles have the same frequencies and phases of ac voltages simultaneously applied thereto.

20. In an apparatus for detecting mass-to-charge ratios of ions, a pair of quadrupole rf electric field producing means arranged in tandem for receiving and maintaining said ions in stable trajectories by producing rf electric fields, at least one of said quadrupole rf electric field producing means providing dc or low frequency quadrupole electric fields coincident with said rf electric fields, structural means providing ion passage means disposed between said quadrupole electric field rf producing means, said structural means isolating said pair of quadrupole rf electric field producing means from one another so that ions can pass from one to the other only through said passage means, said structural means composed of material which permits rf electric fringe fields of either of said quadrupole rf electric field producing means to pass through said structural means into the vicinity of the other said quadrupole rf producing means while said material blocks passage of quadrupole dc fringe fields or supresses low frequency quadrupole electric fringe fields so that the rf electric fringe fields of the two quadrupole rf producing means remain strong throughout the region between such two quadrupole rf electric field producing means whereas said quadrupole dc fringe fields and said low frequency quadrupole electric fringe fields are respectively blocked or suppressed in said region, and means for applying the same frequencies and approximately the same phases simultaneously in said rf electric fields by both said quadrupole rf electric field producing means to improve transmission of ions through said passage means between said pair of quadrupole rf electric field producing means.

* * * * *